US005713604A

United States Patent [19]

Ward, Jr.

[11] Patent Number: 5,713,604

[45] Date of Patent: Feb. 3, 1998

[54] PAPER BINDING STRUCTURE AND METHOD OF FORMING SAME

[76] Inventor: Thomas V. Ward, Jr., 421 Ravine Rd., Hinsdale, Ill. 60521

[21] Appl. No.: 495,359

[22] Filed: Jun. 28, 1995

[51] Int. Cl.[6] ..... B42D 3/18

[52] U.S. Cl. ..... 281/21.1; 281/29; 412/1

[58] Field of Search ..... 281/21.1, 15.1, 281/29, 38, 35–37, 33; 412/1, 4, 6; 283/63.1; 402/80 R, 73

[56] References Cited

U.S. PATENT DOCUMENTS

| | | | |
|---|---|---|---|
| 4,072,326 | 2/1978 | Groswith, III et al. | 281/29 |
| 4,139,216 | 2/1979 | Saint Clair | 281/34 X |
| 4,307,972 | 12/1981 | Errichiello | 402/73 |
| 4,537,544 | 8/1985 | Joost | 412/5 |
| 4,548,426 | 10/1985 | Lockhart . | |
| 4,706,994 | 11/1987 | Lockhart | 281/29 |
| 4,741,655 | 5/1988 | James . | |
| 4,743,048 | 5/1988 | Groswith, III | 281/21.1 |
| 4,747,721 | 5/1988 | Horian . | |
| 4,887,925 | 12/1989 | Groswith, III et al. | 281/21.1 X |
| 4,934,729 | 6/1990 | Colonna | 281/21.1 |
| 4,941,804 | 7/1990 | Sarpy, Jr. . | |
| 4,971,361 | 11/1990 | Whiting | 281/15.1 X |
| 5,116,081 | 5/1992 | Mann, Jr. . | |
| 5,240,340 | 8/1993 | Lynch et al. . | |
| 5,435,598 | 7/1995 | Robinson | 281/21.1 |

*Primary Examiner*—Frances Han
*Attorney, Agent, or Firm*—Meroni & Meroni

[57] ABSTRACT

A binding structure for binding together sheets of paper having multiple openings along a margin thereof is provided. The structure includes a connector panel having multiple openings along a first connector panel edge. An elongated binding element extends adjacent and parallel to the margin of the sheets of paper and the first connector panel edge. The connector panel being disposed on a bottom side of the elongated binding element. A one-piece report cover is provided having a front panel, a center spine panel, and a back panel. The one-piece report cover including a first hinge and a second hinge parallel to the first hinge, the first hinge and second hinge formed integral with the one piece cover and defining respectively pivotal connections between the front panel, the center spine panel, and the back panel. Adhesive strips attach a bottom side of the connector panel to a top side of the back panel. The front panel being pivotal along the first hinge and second hinge so that the front panel is pivotally positionable on top the sheets of paper when in a closed position. The front panel, the back panel, and the sheets of paper being approximately parallel to one another allowing the structure to lay substantially flat.

15 Claims, 2 Drawing Sheets

PAPER BINDING STRUCTURE AND METHOD OF FORMING SAME

BACKGROUND OF THE INVENTION

1. Field of the Invention

The present invention relates to a paper binding structure for holding sheets of a document together. More particularly, the invention pertains to an improved paper binding structure having a report cover which conceals a paper binding member enclosed within and lays substantially flat.

2. Description of the Prior Art

Various prior art binding devices are known in the art. Permanent binding devices are commonly used to produce hard cover books. Semi-permanent binding devices which use metal or plastic binding structures are commonly used when binding together the internal pages of a document and a front and back cover. This binding procedure requires numerous holes to be punched in the margins of the pages to be bound. Binding member of the binding devices engage the holes to secure the pages together. A third type of binding is known as loose leaf binding which is typically associated with three-ring binders.

In producing professional documents, such as business reports and proposals, semi-permanent binding devices are found to be a favorable choice. These binding devices are readily available at a low cost and allow for secure holding of pages while at the same being releasable wherein the pages can be replaced or updated prior to distribution. A main disadvantage with semi-permanent binding devices involves an unprofessional appearance conveyed by such devices. The exposed unprotected metal or plastic binding device is unpresentable for many types of uses.

Several attempts have been made in the art to construct semi-permanent binding devices having report covers connected thereto which will conceal the binding element and to produce an improved appearance. For example, U.S. Pat. No. 4,941,804 issued to Sarpy, discloses a plastic multi-ring paper binding system using a one piece cover. A plastic ring-type binder binds together sheets of paper along a margin. One or more elongated adhesive bead members extend along the binder to connect the binder to the center of a one piece cover. While this device serves to provide a satisfactory binding device, it suffers from the clear disadvantages of having the cover connected to the binder prior to the binding process.

U.S. Pat. No. 4,548,426 issued to Lockhart, discloses a report cover for binding a report. The report cover includes a front panel having three parallel hinges and a rear panel having a single hinge. The sheets of paper making up the report are secured between the front and rear panels near the first edges of the panels by staples. The front panel is then folded about the hinges to lie parallel to and adjacent the rear panel. The front and rear panels are secured along a line distant from the first hinge by an adhesive strip. This device serves to provide a unique binding device, but is suffers from several disadvantages. This device does not employ the use of a plastic or metal semi-permanent binding device, but instead uses staples to secure sheets together. The use of semi-permanent binding devices have been found to be especially cost effective, as well as providing for an easy way to make sheet insertions or deletions without having to use staples which are known to damage paper after repeated use within the same sheets of paper. Furthermore, in this device the first hinges of each panel permits certain portions of the panels and report to pivot about the hinges to attempt to eliminate any force tending to open or close the report.

However, the sheets of the report are connected to the device at an angle which prevents the sheets from laying flat and instead causes a curve or bulge in the report.

As will be described in greater detail hereinafter, the binding structure of the present invention differs from those previously proposed and employs a number of novel features that render it highly advantageous over the aforementioned prior art.

SUMMARY OF THE INVENTION

Accordingly, it is an object of this invention to provide a binding structure having an improved appearance by virtue of the binding element being concealed by an outer cover.

Another object of this invention is to provide a binding structure which have sheets that lay substantially flat when in the closed position to provide a professional appearance, as well as to aid in stacking and handling.

Still another object of this invention is to provide a binding structure that can utilize existing binding equipment.

Yet another object of this invention is to provide a binding structure that requires very little time to make and does not dramatically change the binding operation.

To achieve the foregoing and other objectives, and in accordance with the purposes of the present invention a binding structure for binding together sheets of paper having multiple openings along a margin thereof is provided. The structure comprises a connector panel having multiple openings along a first connector panel edge. An elongated binding element is provided extending adjacent and parallel to the margin of the sheets of paper and the first connector panel edge. The elongated binding element having a plurality of binding members extending through the multiple openings of the sheets of paper and the connector panel to bind the sheets of paper and the connector panel together. The connector panel being disposed on a bottom side of the elongated binding element. A one-piece report cover is provided having a front panel, a center spine panel, and a back panel. The one-piece report cover including a first hinge and a second hinge parallel to the first hinge. The first hinge and second hinge formed integral with the one piece cover and defining respectively pivotal connections between the front panel, the center spine panel, and the back panel. Fastening means for attaching a bottom side of the connector panel to a top side of the back panel are provided so that the elongated binding element is disposed on the back panel extending adjacent and parallel to the second hinge. The from panel being pivotal along the first hinge and second hinge so that the front panel is pivotally positionable on top the sheets of paper when in a closed position. The front panel, the back panel, and the sheets of paper being approximately parallel to one another allowing the structure to lay substantially flat when in the closed position and an open position when the front panel is coplanar with the center spine panel and the back panel.

In accordance with a method of making the invention, the method comprises the steps of: binding sheets of paper and a connector panel along margins of the sheets of paper and an edge of the connector panel with an elongated binding member; forming a first hinge and a second hinge parallel to the first hinge in a one-piece report cover to define respectively pivotal connections between a front panel, a center spine panel, and a back panel of the one-piece report cover; securing the connector panel to the back panel of the one-piece report cover with the elongated binding member extending along an edge of the back panel adjacent to the second hinge; and folding the one-piece report cover about the first hinge and the second hinge to cover the sheets of paper and conceal the elongated binding member.

Other objects, features and advantages of the invention will become more readily apparent upon reference to the following description when taken in conjunction with the accompanying drawings, which drawings illustrate several embodiments of the invention.

DETAILED DESCRIPTION OF THE PREFERRED EMBODIMENT

Figure 1:
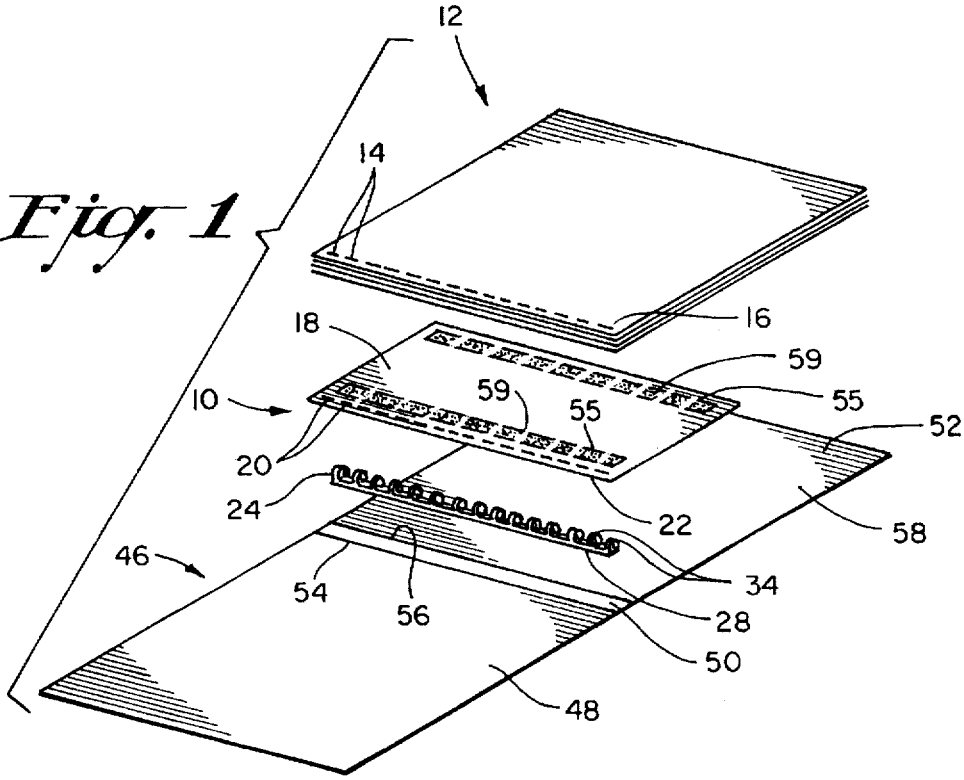
FIG. 1 is an exploded perspective view of the present invention.

Referring now to the drawings, binding structure 10 is illustrated in FIG. 1 for binding together sheets of paper 12 which make up a report. The sheets of paper 12 have multiple openings 14 along a margin 16 thereof.

A connector panel 18 is generally rectangular in shape and has multiple openings 20 along a first connector panel edge 22 which correspond to the openings 14 of the sheets of paper 12.

An elongated binding element 24 is provided to bind the sheets of paper and connector panel 18 together. In one embodiment shown in FIGS. 4 and 5, the elongated binding element 24 is a flexible multiple ring binder or ring-type binder 26 of conventional design formed of plastic or metal and having a generally circular cross-section. The binder 26 generally includes a longitudinally extending rectangular back 28 having an outer convex surface 30 and an inner concave surface 32. A plurality of equally spaced apart semicircular flexible rings or binding members 34 are connected to the back 28 at one end with the opposite distal end 36 being used to penetrate the slots or multiple openings 14 of the sheets of paper. Punching and binding machines which are known in the art may be used in the binding process.

Figure 6:
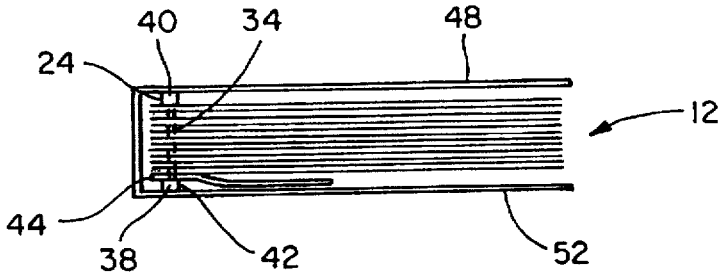
FIG. 6 is a side view of an alternative embodiment of the present invention in an open position.
Figure 7:
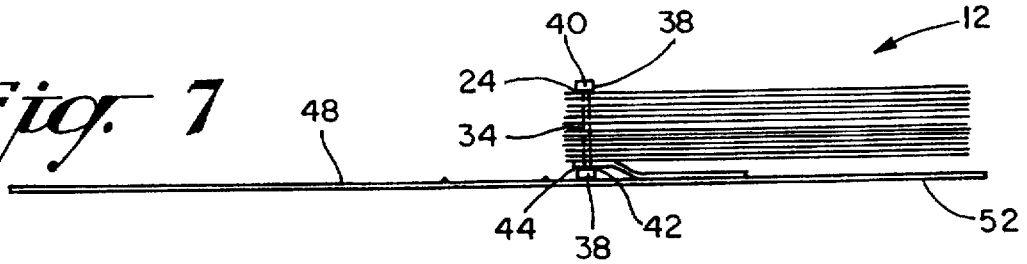
FIG. 7 is a side view of an alternative embodiment of the present invention in a closed position.

In an alterative embodiment shown in FIGS. 6 and 7, the elongated binding element 24 is a plastic bar and pin type binder 38 of the type known commercially as QUICK BIND or VELOBIND which includes a first thin elongated member 40 and a second thin elongated member 42. The second thin elongated member 42 has a plurality of apertures 44. The binding members 34 are elongated and pin shaped and connected to the first thin elongated member 40 with each of the binding members 34 extending through the openings in the sheets of paper 12 and connector panel 18 and into a respective aperture 44 of the second thin elongated member 42.

Figure 4:
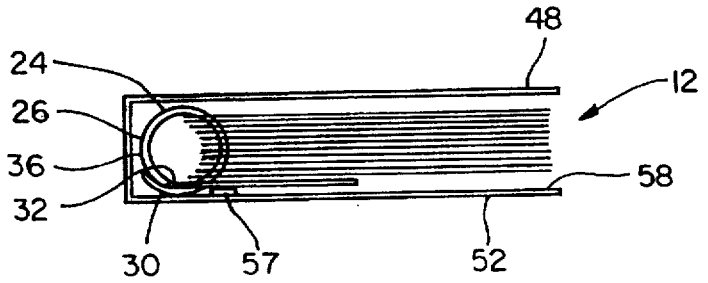
FIG. 4 is a side view of the present invention in a closed position.

After binding, the elongated binding element 24 will extend adjacent and parallel to the margin of the sheets of paper 12 and the first connector panel edge 22. The sheets of paper 12 and the connector panel 18 are bound together with the connector panel 18 being disposed on a bottom side of the elongated binding element 24, as shown in FIG. 4.

Referring to FIG. 1, a one-piece report cover 46 has a front panel 48, a center spine panel 50, and a back panel 52. The one-piece report 48 cover includes a first hinge 54 and a second hinge 56 parallel to the first hinge 54. The first hinge 54 and second hinge 56 are formed integral with the cover 46 and defining respectively pivotal connections between the front panel 48, the center spine panel 50, and the back panel 52. The cover 46 and connector panel 18 are preferably formed of a stiff paper or cardboard, however, plastic or other materials could also be used. The hinges are formed by conventional methods such as scoring or creasing.

A pair of adhesive strips 55 of conventional type, such as two-sided adhesive tape, are provided which extend along a bottom side 57 of the connector panel 18 for attaching the bottom side 57 of the connector panel 18 to a top side 58 of the back panel 52 so that the elongated binding element 24 is disposed on the back panel 52 extending adjacent and parallel to the second hinge 56. Preferably, the strips 55 are positioned in a spaced apart relationship as shown in FIG. 1. The strip 55 which is closest to the first connector panel edge 22 is in a spaced apart relationship from the edge 22, preferrably between 0.25 and 1.0 inches, to allow for some flexability in the connector panel 18 and spacing from the back panel 52 to accomodate the raised level created by the binding element 24 and to allow the binding element 24 to move or pivot.

Figure 2:
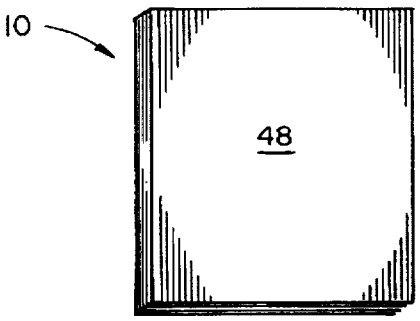
FIG. 2 is a perspective view of the present invention in a closed position.
Figure 3:
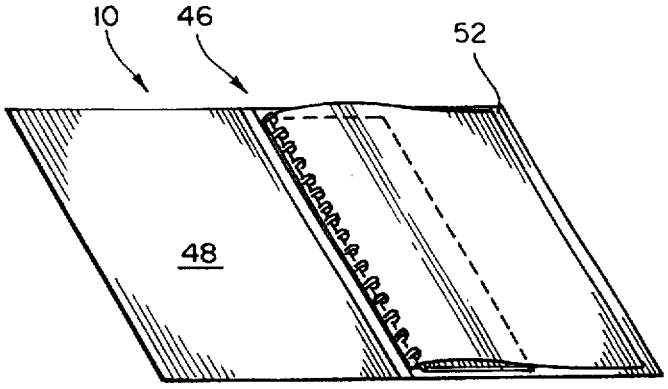
FIG. 3 is a perspective view of the present invention in an open position.

A pair of nonstick protective strips 59 are removably connected to an outside surface of the adhesive strips 55 when the structure is in a non-assembled state, as shown in FIG. 1. The nonstick protective strips 59 being removed from the adhesive strips 55 when the structure is an assembled state, as shown in FIG. 3. When assembled, the front panel 48 is pivotal along the first hinge 54 and second hinge 56 so that the front panel 48 is pivotally positionable on top the sheets of paper 12 when in a closed position, as shown in FIGS. 4 and 6. In FIG. 2, it can be seen the structure 10 provides a binding system that conceals the elongated binding element 24 and has a professional appearance.

Figure 5:
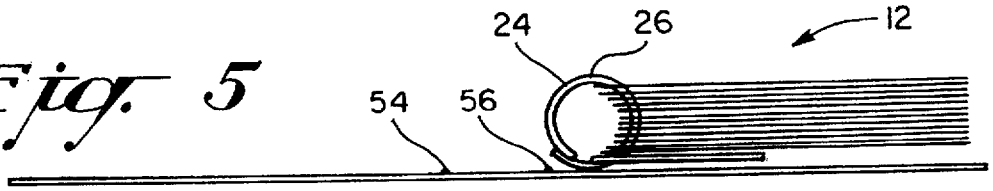
FIG. 5 is a side view of the present invention in an open position.

The from panel 48, the back panel 52, and the sheets of paper 12 are approximately parallel to one another allowing the structure to lay substantially flat when in the closed position, as illustrated in FIGS. 4 and 6, and in an open position when the front panel 48 is coplanar with the center spine panel 50 and the back panel 52, as illustrated in FIGS. 5 and 7. This feature further aides to enhance the professional appearance of the structure 10.

Although the invention has been described by reference to some embodiments it is not intended that the novel device be limited thereby, but that modifications thereof are intended to be included as falling within the broad scope and spirit of the foregoing disclosure, the following claims and the appended drawings.

I claim:

1. A binding structure for binding together sheets of paper having multiple openings along a margin thereof, the structure comprising:

(a) a connector panel having multiple openings along a first connector panel edge;

(b) an elongated binding element extending adjacent and parallel to the margin of the sheets of paper and the first connector panel edge, the elongated binding element having a plurality of binding members extending through the multiple openings of the sheets of paper and the connector panel to bind the sheets of paper and the connector panel together, the connector panel being disposed on a bottom side of the elongated binding element;

(c) a one-piece report cover having a front panel, a center spine panel, and a back panel, the one-piece report cover including a first hinge and a second hinge parallel to the first hinge, the first hinge and second hinge formed integral with the one piece cover and defining respectively pivotal connections between the front panel, the center spine panel, and the back panel; and (d) fastening means for attaching a bottom side of the connector panel to a top side of the back panel so that the elongated binding element is disposed on the back panel extending adjacent and parallel to the second hinge, the front panel being pivotal along the first hinge and second hinge so that the front panel is pivotally positionable on top the sheets of paper when in a closed position, the front panel, the back panel, and the sheets of paper being approximately parallel to one another allowing the structure to lay substantially flat when in the closed position and in an open position when the front panel is coplanar with the center spine panel and the back panel.

2. The structure of claim 1, wherein the elongated binding element is a ring-type binder having a generally circular cross-section, the binding members being semicircular flexible rings.

3. The structure of claim 1, wherein the elongated binding element includes a first thin elongated member and a second thin elongated member, the second thin elongated member having a plurality of apertures, the binding members being pin shaped and connected to the first thin elongated member, each of said binding members extending through a respective aperture of the second thin elongated member.

4. The structure of claim 1, wherein the fastening means includes adhesive.

5. The structure of claim 1, wherein the fastening means includes an adhesive strip extending along the bottom side of the connector panel.

6. The structure of claim 5, further comprising a nonstick protective strip removably connected to the adhesive strip when the structure is in a non-assembled state, the nonstick protective strip being removed from the adhesive strip when the structure is an assembled state.

7. The structure of claim 1, wherein the fastening means includes a parallel pair of adhesive strips extending along the bottom side of the connector panel in a spaced apart relationship and a pair of nonstick protective strips removably connected to the adhesive strips when the structure is in a non-assembled state, the nonstick protective strips being removed from the adhesive strip when the structure is an assembled state.

8. The structure of claim 7, wherein one of the adhesive strips closest to the first connector panel edge is in a spaced apart relationship from the first connector panel edge.

9. A binding structure for binding together sheets of paper having multiple openings along a margin thereof, the structure comprising:

(a) a connector panel having multiple openings along a first connector panel edge;

(b) an elongated binding element extending adjacent and parallel to the margin of the sheets of paper and the first connector panel edge, the elongated binding element having a plurality of binding members extending through the multiple openings of the sheets of paper and the connector panel to bind the sheets of paper and the connector panel together, the connector panel being disposed on a bottom side of the elongated binding element;

(c) a one-piece report cover having a front panel, a center spine panel, and a back panel, the one-piece report cover including a first hinge and a second hinge parallel to the first hinge, the first hinge and second hinge formed integral with the one piece cover and defining respectively pivotal connections between the front panel, the center spine panel, and the back panel;

(d) a parallel pair of adhesive strips extending along a bottom side of the connector panel in a spaced apart relationship for attaching the bottom side of the connector panel to a top side of the back panel when the structure is in an assembled state so that the elongated binding element is disposed on the back panel extending adjacent and parallel to the second hinge, the front panel being pivotal along the first hinge and second hinge so that the front panel is pivotally positionable on top the sheets of paper when in a closed position, the front panel, the back panel, and the sheets of paper being approximately parallel to one another allowing the structure to lay substantially flat when in the closed position and in an open position when the front panel is coplanar with the center spine panel and the back panel; and (e) a pair of nonstick protective strips removably connected to the adhesive strips when the structure is in a non-assembled state, the nonstick protective strips being removed from the adhesive strip when the structure is the assembled state.

10. The structure of claim 9, wherein the elongated binding element is a ring-type binder having a generally circular cross-section, the binding members being semicircular flexible rings.

11. The structure of claim 9, wherein the elongated binding element includes a first thin elongated member and a second thin elongated member, the second thin elongated member having a plurality of apertures, the binding members being pin shaped and connected to the first thin elongated member, each of said binding members extending through a respective aperture of the second thin elongated member.

12. A method of forming a paper binding structure, comprising the steps of:

(a) binding sheets of paper and a connector panel along margins of the sheets of paper and an edge of the connector panel with an elongated binding member, the connector panel remaining flat and being disposed under the sheets of paper;

(b) forming a first hinge and a second hinge parallel to the first hinge in a one-piece report cover to define respectively pivotal connections between a front panel, a center spine panel, and a back panel of the one-piece report cover;

(c) securing the connector panel to the back panel of the one-piece report cover with the elongated binding member extending along an edge of the back panel adjacent to the second hinge with the front panel, the back panel, and the sheets of paper being approximately parallel to one another allowing the structure to lay substantially flat when in the closed position and in an open position when the front panel is coplanar with the center spine panel and the back panel; and (d) folding the one-piece report cover about the first hinge and the second hinge to cover the sheets of paper and conceal the elongated binding member.

13. The method of claim 12, further including the step of applying two adhesive strips along the bottom side of the connector panel in a spaced apart relationship before securing the connector panel to the back panel of the one-piece report cover, the strips of adhesive each having a nonstick protective strip removably connected to an outer side of the adhesive strip.

14. The method of claim 13, wherein the step of applying two adhesive strips include the step of applying one of the adhesive strips closest to the first connector panel edge in a spaced apart relationship from the first connector panel edge.

15. The method of claim 13, wherein the step of securing the connector panel to the back panel of the one-piece report cover further comprises the step of peeling off the nonstick protective strips from the adhesive to expose the outer side of the adhesive.

* * * * *